US006602052B2

(12) United States Patent
Liang

(10) Patent No.: US 6,602,052 B2
(45) Date of Patent: Aug. 5, 2003

(54) AIRFOIL TIP SQUEALER COOLING CONSTRUCTION

(75) Inventor: George Liang, Palm City, FL (US)

(73) Assignee: Alstom (Switzerland) Ltd, Baden (CH)

( * ) Notice: Subject to any disclaimer, the term of this patent is extended or adjusted under 35 U.S.C. 154(b) by 120 days.

(21) Appl. No.: 09/884,018

(22) Filed: Jun. 20, 2001

(65) Prior Publication Data

US 2002/0197160 A1 Dec. 26, 2002

(51) Int. Cl.[7] ..... F01D 5/18
(52) U.S. Cl. ..... 416/97 R; 416/224
(58) Field of Search ..... 416/92, 97 R, 416/224; 415/173.1

(56) References Cited

U.S. PATENT DOCUMENTS

| | | | | | |
|---|---|---|---|---|---|
| 4,197,443 | A | * | 4/1980 | Sidenstick | 219/69 E |
| 4,390,320 | A | * | 6/1983 | Eiswerth | 416/97 R |
| 4,589,823 | A | | 5/1986 | Koffel | |
| 4,606,701 | A | | 8/1986 | McClay et al. | |
| 4,664,597 | A | * | 5/1987 | Auxier et al. | 416/97 R |
| 4,672,727 | A | * | 6/1987 | Field | 29/156.8 B |
| 4,684,323 | A | * | 8/1987 | Field | 416/97 R |
| 4,705,455 | A | * | 11/1987 | Sahm et al. | 416/97 R |
| 5,183,385 | A | | 2/1993 | Lee et al. | |
| 5,403,158 | A | * | 4/1995 | Auxier | 416/97 R |
| 5,564,902 | A | * | 10/1996 | Tomita | 416/97 R |
| 5,660,523 | A | * | 8/1997 | Lee | 416/97 R |
| 5,738,491 | A | | 4/1998 | Lee et al. | |
| 5,752,802 | A | * | 5/1998 | Jones | 415/170.1 |
| 6,086,328 | A | * | 7/2000 | Lee | 416/97 R |
| 6,224,336 | B1 | * | 5/2001 | Kercher | 416/97 R |
| 6,287,075 | B1 | * | 9/2001 | Kercher | 416/97 R |

FOREIGN PATENT DOCUMENTS

| | | |
|---|---|---|
| EP | 0816636 A1 | 1/1998 |
| EP | 1016774 A2 | 7/2000 |

* cited by examiner

*Primary Examiner*—Edward K. Look
*Assistant Examiner*—James M McAleenan
(74) *Attorney, Agent, or Firm*—Burns, Doane, Swecker & Mathis, L.L.P.

(57) ABSTRACT

An airfoil for a gas turbine includes a pressure sidewall and a suction sidewall, a tip cap, and a tip squealer. Cooling fluid flows from a hollow space within the airfoil through exit passages extending to the pressure side of the airfoil and to the tip cavity defined by the tip cap and the tip squealer. The tip squealer includes a smooth contour with curved and straight portions, allowing an even flow of the cooling fluid about the tip squealer and within the tip cavity. Furthermore, the exit passages are partially diffused and oriented at angles with respect to the radial direction. The smooth contour and shape of the exit passages avoids the formation of vortices and enhances film cooling of the tip squealer.

15 Claims, 3 Drawing Sheets

AIRFOIL TIP SQUEALER COOLING CONSTRUCTION

FIELD OF THE INVENTION

The invention relates to hollow airfoils for gas turbines and in particular to a tip squealer and a cooling construction for the tip squealer.

BACKGROUND OF THE INVENTION

The airfoils in gas turbines comprising a pressure side and a suction side which extend from the root to the tip are typically provided with a tip portion. This tip portion protects the airfoil from damage caused by contact with the turbine casing. It consists of a tip cap between the radial ends of the pressure and suction sidewalls and a tip squealer extending radially away from the tip cap along the pressure and suction sidewalls of the airfoil. During operation of the gas turbine the airfoils must withstand very high temperatures. In order to prevent damage due to the high gas temperature, which would shorten the airfoil lifetime, the airfoils are provided with a cooling construction for cooling fluid to flow through and cool the airfoil by various physical means. Between the pressure side and suction sidewalls is a hollow space for cooling fluid, typically air bled from the compressor, to flow through and convectively cool the sidewalls. However, in the region of the tip portion cooling is especially critical as the tip squealer is typically of small thickness and particularly susceptible to high temperature oxidation and other damages due to overheating.

A typical cooling construction for the tip portion is described in EP 0 816 636. A tip squealer extends radially from a tip cap and along the pressure and suction sidewalls of the airfoil. The tip squealer has straight sidewalls and tip crowns of rectangular shape on both the pressure and suction sides. First exit passages for the cooling fluid lead from the hollow space radially through the tip cap to the tip cavity which is enclosed on its sides by the sidewalls of the tip squealer. The cooling fluid flows into the tip cavity and over the suction tip crown, cools that portion convectively, and finally blends into the leakage flow. Second exit passages lead from the hollow space to the pressure side of the airfoil, their axes being oriented at an angle to the radial direction. Cooling fluid flows from the hollow space to the pressure side and passes from there over the pressure side tip crown and through the tip cavity and finally blends into the leakage flow. This type of cooling construction has the disadvantage that in the tip cavity, and in particular along the inside edges of the tip squealer, the cooling fluid can form vortices, which reduce the cooling efficiency. The reduced cooling efficiency results in an increase in the amount of cooling fluid necessary for the cooling.

U.S. Pat. No. 5,183,385 discloses a further cooling construction for the tip portion of a gas turbine airfoil. It comprises a tip squealer with a rectangular cross-sectional shape similar to the construction described above. The cooling passages from the hollow space lead radially through the tip cap into the tip cavity. They have, according to the FIGS. 7–10 of the disclosure, a first straight section and near the surface of the tip cap a funnel-shaped diffused section with a rectangular cross-section such that the outer hole portion defines a rectangular trapezoid. The particular shape provides an expansion of the cooling flow parallel to the squealer surface.

U.S. Pat. No. 5,738,491 describes a further type of cooling construction for an airfoil with a rectangular tip squealer based on convective and conductive cooling. A thermal conductor is fixedly joined to the tip squealer extending radially to the tip cap. The cooling fluid flowing within the hollow space radially inward from the tip cap then removes heat conducted to the tip cap. In a special embodiment the tip cavity is provided with several ribs, chordally spaced and extending between the tip squealer on the pressure side and the tip squealer on the suction side.

SUMMARY OF THE INVENTION

In view of the above-noted deficiencies in the prior art, the invention is directed to a tip squealer cooling construction for an airfoil in a gas turbine that yields an improved cooling efficiency about the tip squealer of the airfoil compared to the cooling constructions of the prior art.

An airfoil for a gas turbine with a pressure side and a suction side comprises a pressure sidewall and a suction sidewall extending from the root to the tip of the airfoil. The tip portion of the airfoil comprises a tip cap and a tip squealer. The tip cap forms the radial end surface of the airfoil while the tip squealer is intended to protect the airfoil tip from damage due to contact with the gas turbine casing about the airfoils. The tip squealer extends radially from the pressure sidewall to a pressure side tip crown and from the suction sidewall to a suction side tip crown. It extends along the edge of the tip cap on the pressure and suction sides of the airfoil. The tip cap and tip squealer define a tip cavity or tip pocket.

Within the airfoil a hollow space for cooling fluid to flow is defined by the inner surfaces of the pressure and suction sidewalls and the inner surface of the tip cap. Several exit passages for cooling fluid are directed from the hollow space within the airfoil to the pressure side of the airfoil and several further exit passages for cooling fluid lead from the hollow space through the tip cap to the tip cavity.

According to the invention the tip squealer has a radial cross-section comprising a smooth contour.

The smooth contour of the tip squealer extends from the crown of the tip squealer on the pressure side, into the tip cavity, along the tip cavity and to the crown of the tip squealer on the suction side. The contour comprises one or more curved sections, or several straight sections, or one or more curved as well as straight sections. In particular, the contour of the tip squealer has no abrupt changes in direction. That is, the difference in radius of curvature of the several curved sections and the differences in incline between the straight sections are small.

The cooling fluid that passes through the exit passages on the pressure side flows around the pressure side tip crown and into the tip cavity, along the contoured cavity surface and on to the suction side tip crown where it blends into the leakage flow of the gas turbine.

As a result of the smooth contour, the exit passage extending from the hollow space through the tip cap to the tip cavity is positioned close to the hot gas wall on the suction side of the airfoil. The cooling fluid passes close to the tip crown on the suction side and thus close to the hot gas surface. This enables a near wall cooling, which removes the heat load near the top portion of the suction side. In comparison, in a conventional tip squealer the exit hole of the cooling passage is placed on the surface of the tip cap and much farther away from the tip crown.

The smooth contour allows an even flow of the cooling fluid about the tip crowns and within the tip cavity. The cooling fluid flowing over the smooth contour experiences no abrupt changes in flow direction, as there are no sharp corners or other abrupt changes in incline. In particular, the smooth contour avoids the formation of vortices. The resulting smooth flow of the cooling fluid enables an enhanced film cooling of the tip cap surface and the tip squealer. This results in an increased cooling effectiveness, which in turn reduces the necessary amount of cooling fluid.

The heat load that is transmitted from the tip portion into the airfoil is proportional to the surface area of the airfoil tip portion, also referred to as the hot gas side surface. The smoothly contoured tip squealer according to the invention has a smaller hot gas side surface compared to a conventional tip squealer with a rectangular contour. Therefore, from the smaller hot gas side surface of the airfoil according the invention a smaller heat load needs to be transmitted into the airfoil, and in turn the necessary amount of cooling fluid is reduced.

Finally, the tip squealer with a smooth contour according to the invention yields an increased tip section fin efficiency, which is the ability to transmit the heat load away from the tip squealer. The tip squealer extends radially away from the airfoil in the manner of fins and conducts the heat load away from the tip crowns through the base area of the fins to the primary airfoil cooling passages or the hollow space within the airfoil. The tip squealer with a smooth contour has an increased base area compared to a rectangular tip squealer and therefore conducts heat away from the tip crowns more efficiently.

In a particular embodiment of the invention the tip squealer comprises within the tip cavity one or more curved portions, or one or more straight portions, or one or more straight and curved portions. Again the incline angles of the straight portions and the-radii of curvature of the curved portions are chosen such that there are no abrupt changes in direction of a cooling fluid flowing over the surface of the tip cavity and about the squealer tip crowns.

In a particular and preferred embodiment of the invention the contour of the tip squealer comprises within the tip cavity two curved portions and one straight portion between the pressure side tip crown and the center of the tip cavity. The first curved portion extends from the pressure side tip crown toward the center of the tip cap and preferably has a radius of curvature less than 0.03 inch. The second curved portion extends from the first portion toward the center of the tip cap and has a radius of curvature greater than the height of the squealer and preferably greater than 0.4 inch. The straight portion extends from the second curved portion to the center of the tip cap and is at a 3° to 45° incline angle relative to the center line of the tip cap.

In a further preferred embodiment of the invention the contour of the tip squealer comprises within the tip cavity a second straight portion extending from the center of the tip cap to the inner edge of the suction side tip crown. This second straight portion is at a 15° to 45° incline angle relative to the center line of the tip cap.

In a further preferred embodiment of the invention the exit passages that extend from the hollow space to the pressure side of the airfoil each have a passage axis that is oriented at an angle with respect to the radial direction. The radial direction is defined as the radially outward direction of the inner surface of the pressure sidewall. The passage axis is furthermore oriented at an angle with respect to the streamwise direction, which is the direction along the hot gas flow from the leading edge to the trailing edge of the airfoil.

In a particular embodiment of the invention the axis of the exit passage extending to the pressure side of the airfoil is directed at an angle with respect to the radial direction that is in the range from 15° to 65°, preferably in the range from 20° to 35° directed away from the pressure side tip crown, and at an angle with respect to the streamwise direction that is in the range from 30° to 90°, preferably in the range from 45° to 90°.

In a further particular embodiment of the invention the exit passages extending from the hollow space through the tip cap to the tip cavity each have a passage axis that is oriented at an angle with respect to the radial direction as well as at an angle with respect to the streamwise direction.

In a preferred embodiment of the invention the angle of the axes of the exit passages with respect to the radial direction is in a range from 0° to 45°, preferably from 20° to 30°, and directed toward the suction side tip crown. The angle with respect to the streamwise direction is in a range from 35° to 90°, preferably from 35° to 55°.

These particular orientations of the axes of the exit passages direct the cooling fluid flow more smoothly onto the tip squealer such that the cooling fluid flows onto the tip squealer with no great changes of direction. This measure contributes to a further increase in film cooling effectiveness.

In a further embodiment of the invention each of the exit passages leading to the pressure side have a diffused shape either over the entire length of the exit passage or at least over the end portion of the exit passage leading to the exit port. In the latter case the exit passage has a cylindrical shape beginning at the hollow space of the airfoil and extending into a part of the exit passage length and a diffused shape extending from the cylindrical part to the exit port of the passage. The cylindrically shaped portion of the exit passage is intended to meter or control the cooling flow through the passage.

Furthermore, the diffusion of the exit passage is either on all sides of the passage axis or only to one side of the passage axis. In the latter case, the diffusion is directed toward the pressure side tip crown of the squealer. The exit passage then has a cross-section perpendicular to the cooling fluid flow direction that is partially circular and partially oval.

In a further embodiment of the invention the same characteristics apply to the exit passages leading from the hollow space to the tip cavity. They comprise a diffused shape directed toward the suction side tip crown. Again the diffused shape is either over the entire length of the exit passage or at least over the end portion of the exit passage leading to the exit port of the passage. In the latter case the exit passage has a cylindrical shape beginning at the hollow space of the airfoil and extending into a part of the exit passage length and a diffused shape extending from the cylindrical part to the exit port of the passage.

Furthermore, the diffusion is either to all sides of the passage axis or only to one side of the passage axis. In the latter case, the diffusion is directed toward the suction side tip crown of the squealer. The exit passage then has a cross-section perpendicular to the cooling fluid flow direction that is partially circular and partially oval.

The diffusion of the exit passage is intended to spread out the cooling fluid as it approaches the exit port of the exit passage and lower its exit velocity as it flows onto the tip squealer. This yields a further improvement of the film cooling effectiveness as a greater amount of the cooling fluid remains close to the surface of the tip squealer.

In a particular embodiment of the invention the sidewalls of the exit passages extending to the pressure sidewall are oriented at an angle with respect to the exit passage axis that is in the range from 7° to 12° and directed toward the pressure side tip crown.

In a further particular embodiment the sidewalls of the exit passage extending from the hollow space to the tip cavity has sidewalls that are oriented at an angle with respect to the exit passage axis in the range from 7° to 12° and directed toward the suction side tip crown.

In a further embodiment the exit passages from the hollow space to the tip squealer, both the exit passages leading to the pressure side as well as to the tip cavity, have sidewalls that are diffused at an angle with respect to the passage axis and directed toward the streamwise direction.

This effects a wider flow from the exit passage onto the tip squealer surface and further improves the film cooling.

DETAILED DESCRIPTION OF THE INVENTION

Figure 1:
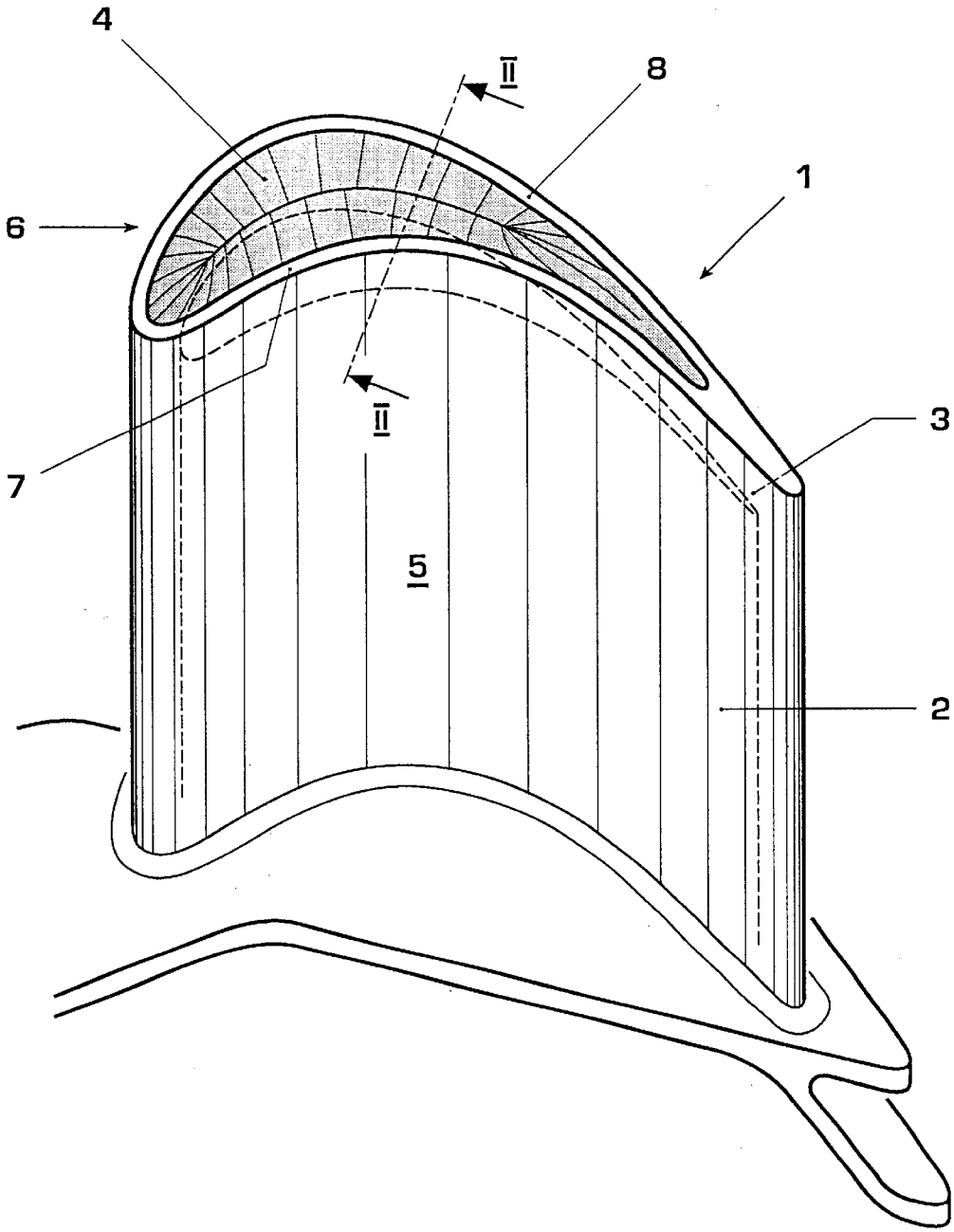
FIG. 1 shows a perspective view of an airfoil with a tip portion comprising a tip squealer according to the invention.

FIG. 1 shows a perspective view of an airfoil 1 for a gas turbine according to the invention comprising a pressure sidewall 2, a suction sidewall 3, and a tip cap 4 at the radial termination of the airfoil 1. Within the airfoil 1 a hollow space 5 is defined by the inner surfaces of the pressure sidewall 2, the suction sidewall 3, and the tip cap 4. A cooling fluid, typically air bled from the compressor of the gas turbine, circulates within the hollow space 5 cooling the pressure and suction sidewalls by convection.

The figure shows in particular the tip portion of the airfoil comprising a tip squealer 6, which protects the airfoil tip portion from damage in case of contact with the gas turbine casing. The tip squealer 6 extends radially from the pressure sidewall 2 and the suction sidewall 3 to the pressure side tip crown 7 and suction side tip crown 8, respectively. The tip squealer 6 and the tip cap 4 define a tip cavity, also referred to as a tip pocket 9. According to the invention, the tip squealer 6 has a contour within the tip cavity that is smooth rather than rectangular. For simplicity the exit passages for the cooling fluid from the hollow space are not shown in FIG. 1, but in the following figures.

Figure 2A:
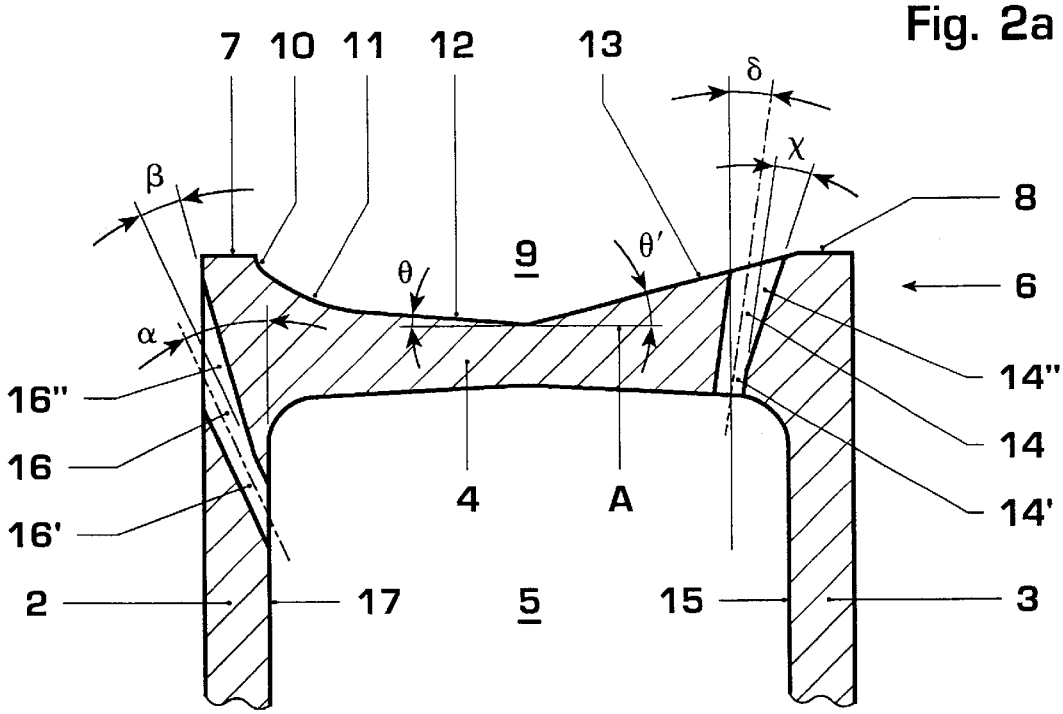
FIG. 2*a* shows a cross-sectional view of the tip portion taken along the lines II—II in FIG. 1, showing the tip squealer according to the invention and exit passages for the cooling fluid according to the invention.

FIG. 2*a* shows a radial cross-section of the tip portion of an airfoil 1 with the pressure sidewall 2, the suction sidewall 3, and the tip cap 4 whose inner surfaces define the hollow space 5. FIG. 2*a* shows in particular the smooth contour of the tip squealer 6. Beginning at the pressure side tip crown 7 the contour comprises a first curved portion 10, a second curved portion 11, and a flat portion 12.

The first curved portion 10 is a short portion with a radius of curvature preferably less than 0.03 inch. The first curved portion 10 is followed by the second curved portion 11 that has a radius of curvature preferably greater than 0.4 inch and no less than the height of the squealer. The flat portion 12 is inclined with respect to the center line A of the tip cap at an angle $\theta$ in the range from 3° to 15°. A second flat portion 13 extends from the center of the tip cap to the inner edge of the suction side tip crown 8. The second flat portion 13 is oriented at an angle $\theta'$ with respect to the center line A of the tip cap ranging from 15° to 45°.

In a variant of the tip squealer illustrated in FIG. 2*a* the crowns of the squealer, especially the pressure side tip crown, have rounded edges which allow a smoother flow of the cooling fluid about the tip crowns into and out of the tip cavity.

In FIG. 2*a* a first exit passage 14 extends from the hollow space 5 through the tip cap 4 to the tip cavity 9 near the suction side tip crown 8. The axis of exit passage 14 is oriented at a slight angle $\delta$ with respect to the radial direction, where the radial direction is the direction along the broken line running parallel to the inner surface 15 of the suction sidewall 3. This angle $\delta$ is in the range from 0° to 45° directed toward the suction side tip crown. In view of the film cooling effectiveness a larger angle $\delta$ yields better results. However, a large angle would require the placement of the exit passage farther away from the suction sidewall, which would lower the benefits of near wall cooling. Hence, an angle $\delta$ in the range from 20° to 30° is a preferred compromise.

Figure 2B:
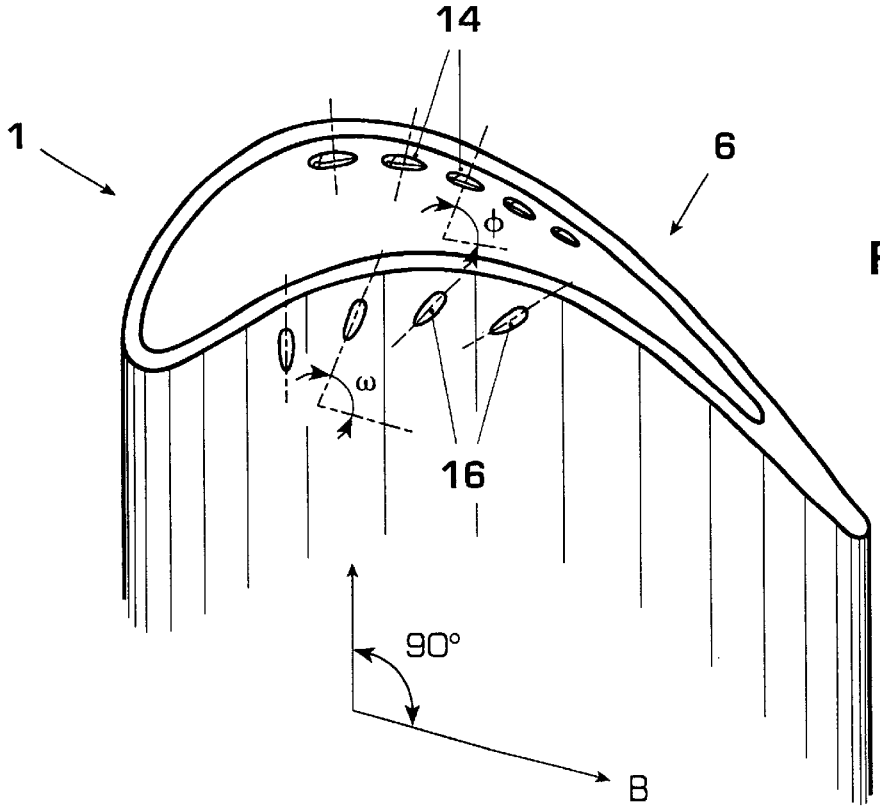
FIG. 2*b* illustrates the streamwise direction for the airfoil and shows the orientation of the exit passages with respect to the streamwise direction.

As shown in FIG. 2*b*, the axis of the exit passage 14 is further oriented at an angle $\phi$ with respect to the streamwise direction, which is the direction of the hot gas flow from the leading to the trailing edge of the airfoil. The axis is oriented at an angle $\phi$ in the range from 35° to 90° relative to the streamwise direction and directed toward the airfoil trailing edge.

The exit passage 14 comprises a first portion 14' having a cylindrical shape and a second portion 14" having a cylindrical shape in a first half and a diffused shape in the second half. The sidewall of the second portion is diffused and extends toward the suction side tip crown 8 at the angle $\chi$ with respect to the exit passage axis. The angle $\chi$ is in the range from 7 to 12°. The angle $\chi$ is with respect to the radial direction. The exit passage can also be diffused at an angle with respect to the streamwise direction and directed to the trailing edge of the airfoil where this diffusion angle is also in the range from 7° to 12°.

A second exit passage 16 extends from the hollow space 5 through the pressure sidewall 2 to the outside wall of the tip squealer 6. Its axis is oriented at an angle $\alpha$ with respect to the radial direction or with respect to the inner surface 17 of the pressure sidewall 2. Exit passage 16 comprises a first portion 16' with a cylindrical shape, which meters the cooling fluid flow through the passage, and a second portion 16" having a partially diffused shape. The second half 16" has a sidewall extending at an angle $\beta$ with respect to the passage axis toward the tip cavity. The angle $\alpha$ is in the range from 15° to 65° and the angle $\beta$ is in the range from 7° to 12°. In addition, the axis of passage 16 can be oriented at an angle $\omega$ ranging from 45° to 90° relative to the streamwise direction as shown in FIG. 2*b*. The smooth contour of the tip squealer 6 and the shape of the exit passages 14, 16 enable an enhanced film cooling of the tip squealer 6 and tip cap 4 in comparison to conventional tip squealers. The diffused shape of the exit passages 14 and 16 lowers the exit velocity of the cooling fluid flow and allows the cooling fluid to more readily follow the contour of the tip squealer. The smooth contour furthermore avoids the formation of vortices which otherwise would form in the vicinity of sharp corners. Thus the cooling fluid is optimally directed to film cooling of the squealer surface.

FIG. 2*b* shows an airfoil with some of the exit passages 14 and 16 for the cooling fluid and in particular the orientation of the passage axes with respect to the streamwise direction. The exit passages 16 on the pressure side of the airfoil 1 are oriented at the angle ω with respect to the streamwise direction B, which is the direction of the hot gas flow from the leading to the trailing edge of the airfoil. The exit passages 14 on the suction side of the airfoil are oriented at the angle ϕ with respect to the streamwise direction B.

Figure 2C:
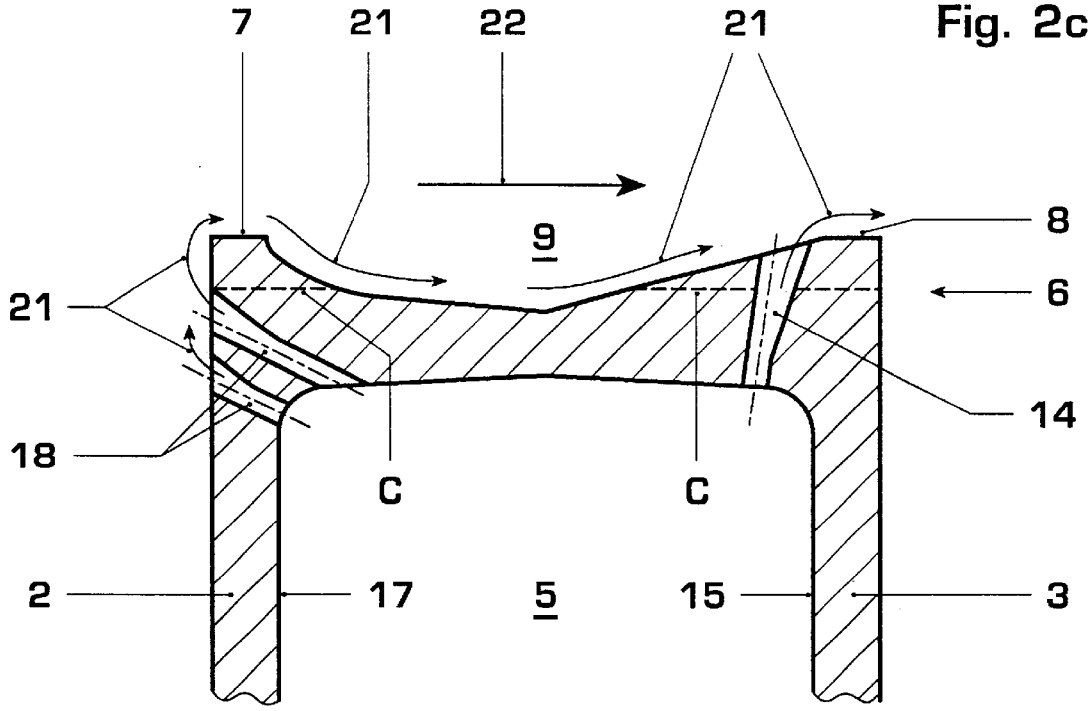
FIG. 2*c* shows the same view as in FIG. 2*a* with exit passages for the cooling fluid according to an embodiment of the invention.

FIG. 2*c* illustrates the flow of the cooling fluid 21 out of exit passages 18, around the tip crown 7 and along the smooth contour of the tip squealer 6. The cooling fluid continuously follows the surface of the tip squealer without forming any vortices. The cooling fluid is thus optimally directed to film cooling, and the cooling efficiency is increased compared to the cooling efficiency in conventional cooling constructions. The cooling fluid 21 flowing out of the exit passage 14 cools the tip squealer near the tip crown 8. The smooth contour of the tip squealer and the resulting position of the exit port of passage 14 with respect to the crown 8 effects an improved cooling of the crown by means of near wall cooling. After cooling the squealer surface and crowns the cooling fluid then leaves the airfoil tip and blends into the leakage flow 22 of the gas turbine.

As discussed above, the tip squealer conducts the heat load from the tip portion into the airfoil and to the primary cooling construction within the hollow space of the airfoil. The fin efficiency, or efficiency to conduct heat away from the tip crowns, is a function of the base area C indicated by the broken lines in FIG. 2*c*. The tip squealer according to the invention provides an increased base area compared to a tip with a rectangular contour. Hence the fin efficiency of this new tip squealer is increased.

Instead of the one exit passage on the pressure side, as in FIG. 2*a*, two exit passages 18 are shown. Their axes are oriented at a greater angle with respect to the inner surface 17 of the pressure sidewall 2. Similar to the other exit passages described, they also have a first cylindrical portion and a second portion with part cylindrical and part conical shape. The diffusion angles of the sidewalls of the passages extending from the passage axis toward the tip cavity 9 are in the range from 45 to 65° relative to the radial direction and from 35° to 55° relative to the streamwise direction.

In the cooling construction as shown in FIG. 2*c* the cooling passages are more in line with the contoured tip cap. This yields a greater convection area for removal of heat from the tip cap. Furthermore, the cooling passages are closer to the contoured tip cap surface. This results in a shorter conduction path, which allows for a better near wall cooling. Finally, the cooling passages are oriented more in line with the hot gas leakage flow, which results in a reduction of aerodynamic mixing loss.

Figure 3:
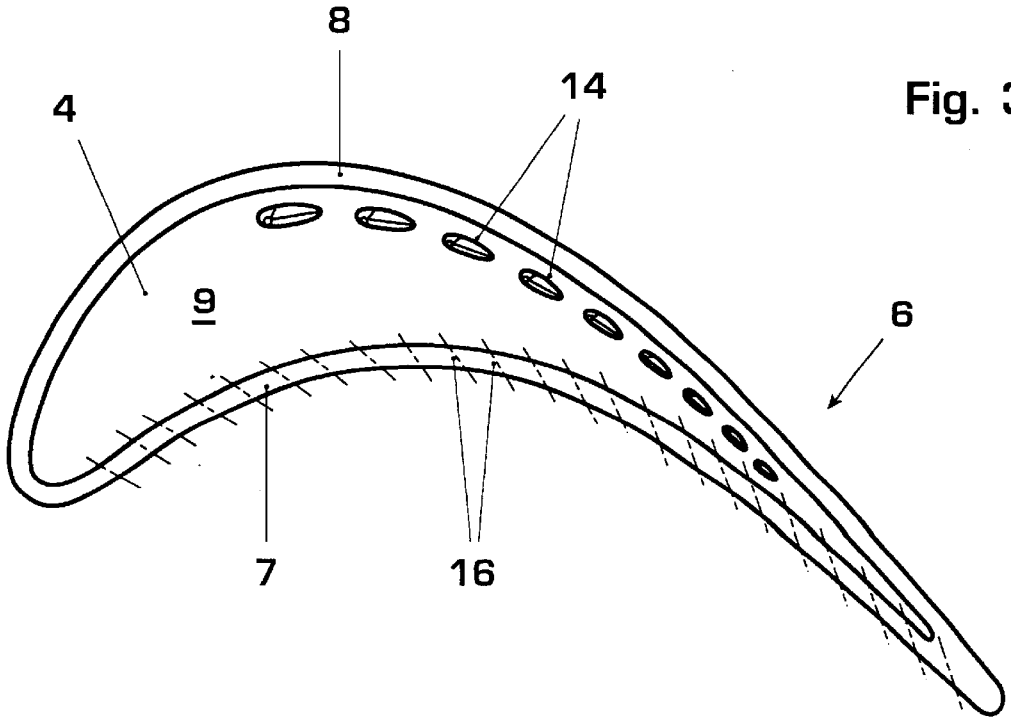
FIG. 3 shows a top view of the tip portion of the airfoil with exit holes of the exit passages at the surface of the tip cap and shows the orientation and diffusion of the exit passages leading through the pressure side of the tip squealer.

FIG. 3 shows, for further understanding of the shape of the diffused exit passages, a top view of the tip squealer 6 according to the invention. It shows the exit ports of passages 14 on the suction side of the airfoil whereas the orientation of the exit passages 16 on the pressure side are indicated. Furthermore, the different diffusion angles relative to the radial and the streamwise direction are indicated. This compounded angle diffusion hole is used for the suction side and is intended to spread out the cooling air toward the suction tip crown as well as along the suction side tip crown.

What is claimed is:

1. An airfoil for a gas turbine, comprising:

a pressure sidewall, a suction sidewall, a tip cap, and a tip squealer;

a hollow space for cooling fluid to flow through, said hollow space being defined by an inner surface of the pressure sidewall, an inner surface of the suction sidewall, and the tip cap;

the tip squealer extending radially away from the pressure sidewall to a pressure side tip crown and from the suction sidewall to a suction side tip crown of the airfoil;

the tip cap and the tip squealer defining a tip cavity;

a plurality of exit passages leading from the hollow space to the tip squealer on the pressure side of the airfoil and a plurality of exit passages leading from the hollow space to the tip cavity near the suction side of the airfoil for cooling fluid to flow through in order to cool the tip squealer; and the tip squealer has a radial cross-section comprising a smooth contour, the smooth contour extending from the pressure side tip crown, into the tip cavity, along the tip cavity and to the suction side tip crown, and the smooth contour having no abrupt changes in direction along its extent.

2. The airfoil according to claim 1, wherein:

the contour of the tip squealer comprises within the tip cavity one or more straight portions or one or more curved portions or both one or more straight portions and one or more curved portions.

3. The airfoil according to claim 2, wherein:

the smooth contour of the tip squealer comprises a first curved portion extending from the pressure side tip crown toward the tip cavity where the first curved portion has a radius of curvature less than 0.03 inch, and a second curved portion extending from the first curved portion toward the center of the tip cavity where the radius of curvature of the second curved portion is at least the height of the tip squealer, and the tip squealer comprises a straight portion extending from the second curved portion to the center of the tip cavity where the straight portion has an incline angle (θ) in the range from 3° to 45° with respect to the center line of the tip cap.

4. The airfoil according to claim 3, wherein:

the contour of the tip squealer comprises a second straight portion extending from the center of the tip cavity to the suction side tip crown that has an incline angle (θ') with respect to the center line of the tip cap in the range from 15° to 45°.

5. The airfoil according to claim 3, wherein:

the radius of curvature of the second curved portion is greater than 0.4 inch.

6. The airfoil according to claim 1, wherein:

the exit passages leading from the hollow space to the tip squealer on the pressure side of the airfoil each have a passage axis that is oriented at an angle (α) with respect to the radial direction and directed away from the pressure side tip crown and at an angle (ω) with respect to a streamwise direction which is the direction of hot gas flow from a leading edge to a trailing edge of the airfoil.

7. The airfoil according to claim 6, wherein:

the angle (α) is in the range from 15° to 65°, and the angle (ω) is in the range from 30° to 90°.

8. The airfoil according to claim 7, wherein:

the angle (α) is in the range from 20° to 35° and the angle (ω) is in the range from 45° to 90°.

9. The airfoil according to claim 1, wherein:

the exit passages leading from the hollow space to the tip cavity each have a passage axis that is oriented at an angle (δ) with respect to the radial direction and directed toward the suction side tip crown and at an angle (φ) with respect to the streamwise direction.

10. The airfoil according to claim 9, wherein:

the angle (δ) is in the range from 0° to 45°, and the angle (φ) is in the range from 35° to 90°.

11. The airfoil according to claim 10, wherein:

the angle (δ) is in the range from 20° to 30° and the angle (φ) is in range from 35° to 55°.

12. The airfoil according to claim 1, wherein:

the exit passages leading to the pressure side of the airfoil have over at least a portion of their entire length a diffused shape or a partially diffused shape, and the exit passages leading from the hollow space to the tip cavity have over at least a portion of their entire length a diffused shape or a partially diffused shape.

13. The airfoil according to claim 12 wherein:

the exit passages leading to the pressure side of the airfoil and the exit passages leading from the hollow space to the tip cavity each have a first portion having a cylindrical shape and a second portion having a diffused shape.

14. The airfoil according to claim 12, wherein:

the exit passages extending from the hollow space to the pressure side of the airfoil each have a sidewall that is oriented at an angle (β) to the axis of the exit passage that is in the range from 7° to 12° and directed toward the pressure side tip crown, and the exit passages leading from the hollow space to the tip cavity each have a sidewall that is oriented at an angle (χ) to the axis of the exit passage that is in the range from 7° to 12° and directed toward the suction side tip crown.

15. The airfoil according to claim 14, wherein:

the exit passages leading from the hollow space to the tip cavity and the exit passages extending from the hollow space to the pressure side of the airfoil each have a sidewall that is oriented at an angle with respect to their passage axis and directed toward the streamwise direction that is in the range from 7° to 12°.

* * * * *